United States Patent [19]

Minogue

[11] 4,139,957

[45] Feb. 20, 1979

[54] LOW ENERGY SIGN ILLUMINATION SYSTEM

[75] Inventor: Robert W. Minogue, Hayward, Calif.

[73] Assignee: Federal Signal Corporation, Chicago, Ill.

[21] Appl. No.: 779,975

[22] Filed: Mar. 22, 1977

[51] Int. Cl.[2] ..... G09F 13/04

[52] U.S. Cl. ..... 40/572; 40/573

[58] Field of Search ..... 40/132 R, 132 D, 130 R, 40/130 J, 130 L, 152.2, 549, 564, 572, 573; 340/334; 313/113; 362/215, 228, 236, 240, 1, 341, 2, 6, 361, 812

[56] References Cited

U.S. PATENT DOCUMENTS

| | | | |
|---|---|---|---|
| 1,574,449 | 2/1926 | Simons | 362/241 X |
| 1,681,491 | 8/1928 | Long | 362/812 X |
| 2,191,353 | 2/1940 | Poblocki | 40/132 R |
| 3,539,801 | 11/1970 | Bobrick | 362/240 X |

*Primary Examiner*—John F. Pitrelli

*Assistant Examiner*—G. Lee Skillington

*Attorney, Agent, or Firm*—Townsend and Townsend

[57] ABSTRACT

A low energy sign contruction is illustrated for illumination of signs of the type having translucent illuminated faces. An opaque sign border is bridged by a reflector extending generally parallel to the illuminated face and having a truncated sawtooth profile. For single sided signs, one set of sawtooth points is truncated; for dual sided signs, both set of sawtooth points are truncated.Bayonet mounted lighting sockets are mounted at apertures in the respective truncations and utilize the metallic reflective surface as one side of a low voltage (10.5-volt) AC circuit. The reflector forms a cooled heat sink mounting the bulbs as well as a supporting matrix. The lamps, as mounted to this supporting matrix, are typically spaced at distances which do not exceed twice the distance of the lamp filament to the translucent face. By the expedient of using 14-volt lamps, prolonged lamp life with low energy illumination results.

10 Claims, 4 Drawing Figures

LOW ENERGY SIGN ILLUMINATION SYSTEM

This invention relates to a low energy sign illumination construction. It is applicable to the signs of the type wherein an illuminated translucent face displays an advertising message on either one or both sides of an advertising sign.

SUMMARY OF THE PRIOR ART

Heretofore it has been conventional to illuminate signs with neon tubing. Such neon tubing type illumination has marked disadvantages.

First, the power supplies for such neon tubing are of high voltage. This voltage, in the order of 5,000 volts, is a hazard during installation or repair. Moreover, with inevitable accidents such sign illumination can be and often is the source of fire. Additionally, the energy requirements are high. Finally, neon lighting has an electromagnetic spectrum of narrow and discrete ranges. These narrow and discrete ranges cause the translucent coloring of covering signs to appear other than as intended. Moreover, neon tubing is especially blown and bent by skilled personnel at high cost.

Arrays of fluorescent bulbs have been used for sign illumination. Such fluorescent bulbs are not without correspondent disadvantages.

Where fluorescent tubes are mounted across translucent signs, they restrict the length of the frame in dimension. Typically, the frames must be built to the length of the fluorescent illumination. Alternately an elaborate stagger system has to be developed; the fluorescent tubes must be elaborately patterned in an interior array so that their irregularity will not develop hot spots interior of the sign. Moreover, such fluorescent bulbs likewise present narrow and discrete electromagnetic spectra which can distort colorings of a translucent material placed over the sign. As in the case of neon, they have comparatively high energy requirements.

SUMMARY OF THE INVENTION

A low energy sign construction is illustrated for illumination of signs of the type having translucent illuminated faces. An opaque sign border is bridged by a reflector extending generally parallel to the illuminated face and having a truncated sawtooth profile. For single sided signs, one set of sawtooth points is truncated; for dual sided signs, both sets of sawtooth points are truncated. Bayonet mounted lighting sockets are mounted at apertures in the respective truncations and utilize the metallic reflective surface as one side of a low voltage (10.5-volt) AC circuit. The reflector forms a cooled heat sink mounting the bulbs as well as a supporting matrix. The lamps, as mounted to this supporting matrix, are typically spaced at distances which do not exceed twice the distance of the lamp filament to the translucent face. By the expedient of using 14-volt lamps, prolonged lamp life with low energy illumination results.

OTHER OBJECTS AND ADVANTAGES OF THE INVENTION

An object of this invention is to disclose a lighting circuit for a low energy illuminated sign which utilizes the reflective interface of the sign as one part of the circuit. According to this invention, a sign is illuminated by a plurality of 14-volt socketless lamps. These lamps are mounted within bayonet-type fixtures which utilize as one side of the cirucuit a metallic reflector. The other side of the circuit is provided with conventional wiring from a 10.5-volt stepdown transformer.

An advantage of the wiring of this invention is that the electrical connection to the discrete lamps is simplified by the expedient of mounting the lamps to the reflective surface with one terminal of each lamp electrically connected thereto. Then, by running a wire to the remaining terminal of each lamp in a chain-like fashion, a parallel circuit configuration is achieved.

A further advantage of this aspect of the invention is that low voltage lamps in parallel connection are adapted to a large advertising display. The elaborate power connections and power supplies associated with high voltage neon lamps need not be used.

Furthermore, elaborate safety precautions for installation and the like need not occur. Rather, all that need be provided is a sealed step-down transformer with paired output leads, one being connected to the sign's reflective backing and the other being connected in a chain-type connection to the discrete lamps.

Another advantage of this invention is that low energy outputs are utilized by the sign illumination. By the expedient of spacing the bulbs at twice the distance between their filaments and translucent surface of the sign, maximum illumination is achieved with a minimum energy requirement.

Another object of this invention is to disclose in combination with the low energy illumination circuit a sign construction. In a sign constructed according to this aspect of the invention a reflective surface is mounted immediately behind a plurality of 14-volt lamps. These lamps are wired in parallel and use the reflective surface as one side of the low voltage connection. The opposite side of the low voltage connection is conventionally wired to the sockets.

An advantage of the construction of this invention is that the illumination no longer forms a consideration in the dimensioning of the signs. Since neon is not used, discrete minimum lengths of neon tubing need not be used in a sign. Since fluorescent tube lighting is not used, sizing of the sign interior to the size of fluorescent tube lights is not required. Stagger systems of mounting are not required.

Yet another object of the invention is to disclose a lamp mounting array for placement interior of signs having a translucent face on one side. According to this aspect of the invention, the sign is provided with a reflector sheet extending parallel to the sign face. The reflector has a generally corrugated configuration, the profile being more precisely described as a truncated sawtooth with one set of the sawtooth points truncated by a plane parallel to the plane of extension of the relector. Lamps electrically connected in accordance with the low energy aspect of this invention are mounted at the bottom of the truncation. Preferably their filaments are all aligned parallel to their immediate backing and reflective surfaces.

A related object of this invention is to disclose a convenient sign mount configuration in which a plurality of lamps can be mounted to illuminate both sides of a sign. In accordance with this aspect of the invention, the sign is provided with a reflector sheet extending parallel to the sign faces. The reflector has a generally corrugated configuration, the profile being more precisely described as a truncated sawtooth with both sets of sawtooth points truncated by two spaced planes parallel to the plane of extension of the reflector. This defines a set of flat-bottomed channels concave toward one face, and an alternating set of channels concave toward the other face. Some of the lamps are mounted at the bottoms of one set of channels, and the remaining lamps are mounted at the bottoms of the other set of channels and facing in the opposite direction.

An unexpected advantage of the reflector configuration of this invention is that the overall illumination of the sign surface is even, in spite of the fact that the illumination is provided by discrete lightbulbs. This is in contrast to the expected result which would have hot spots and uneven illumination of the sign front.

A further advantage of the reflector configuration is that the reflector serves as a heat sink to keep the bulbs cool. Thus, in addition to its function in reflecting the light, the reflector serves three additional functions, namely that of a common electrical ground, that of a heat sink to keep the bulbs cool, and that of a mechanical matrix for mounting the lamps. By using this single member to perform the discrete optical, mechanical, electrical, and thermal functions, a surprisingly simple, lightweight, inexpensive, and efficient illuminated sign results.

Other objects, features and advantages of this invention will become more apparent after referring to the following specifications and attached drawings in which.

DETAILED DESCRIPTION OF THE DRAWINGS

Figure 1:
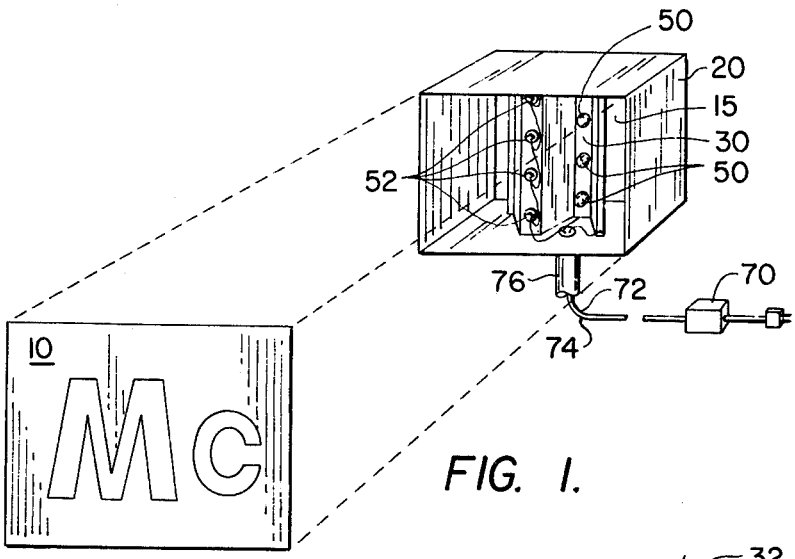
FIG. 1 is a partially exploded perspective view of the invention.

In FIG. 1, a dual-sided sign constructed according to the teaching of this invention is shown. Translucent face 10 with a typical advertising message inscribed is shown removed from opaque frame 20 to disclose the interior components — reflector 30, lamps 50, sockets 52, and the wiring which is described below. A second translucent face 15 is shown in place.

Step-down transformer 70, normally situated outside frame 20, has output leads 72 and 74 which pass through conduit 76, thereby ending up inside frame 20.

Figure 2:
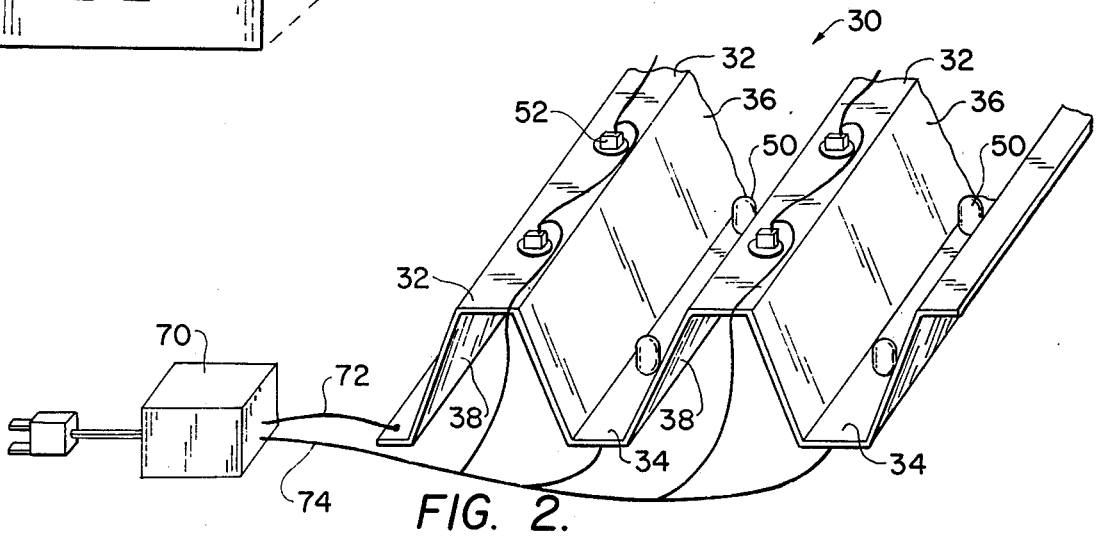
FIG. 2 is a perspective view of the reflector for a sign having two translucent faces. The lamps, sockets, step-down transformer, and electrical connections are also shown; and, FIGS. 3*a* and 3*b* illustrate the bulb sockets and method of mounting to the reflector.

FIG. 2 illustrates the construction of reflector 30, and the manner in which the mounting and wiring of bulbs 50 cooperate therewith to result in the overall invention. Reflector 30, which is ordinarily made out of aluminum sheet, has a corrugated configuration. Discrete coplanar segments 32 define a plane which is parallel to and remote from the plane defined by discrete coplanar segments 34. Segments 32 and 34 are joined by two nonparallel sets of discrete, parallel (but not coplanar) segments, the segments of one set being designated by numeral 36 and those of the other by 38. The inclination of segments 36 and 38 is such to produce, in cooperation with segments 32 and 34, a truncated sawtooth profile. As can be seen from FIG. 2, reflector 30 thus consists of a series of upwardly facing concavities (each defined by a segment 36, 34 and 38), alternating with a series of downwardly facing concavities (each defined by a segment 38, 32 and 36).

A linear array of bulbs 50 is mounted in each concavity. As shown in FIG. 2, the bulbs are mounted in sockets 52. Only those sockets for the bulbs in the downward facing concavities can be seen in the figure and similarly only those bulbs in the upwardly facing concavities can be seen. Each socket is mounted by inserting it through a hole that has been punched in the sheet metal of reflector 30.

Figure 3A:
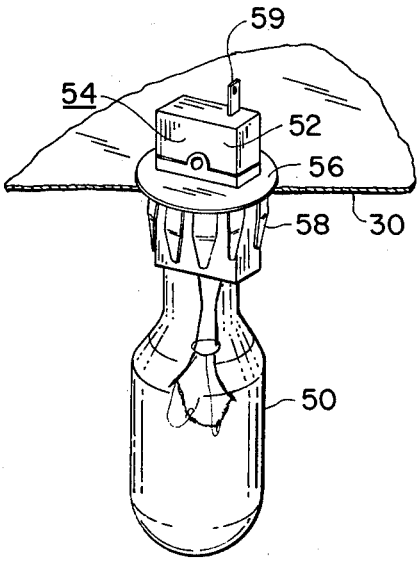
Figure 3B:
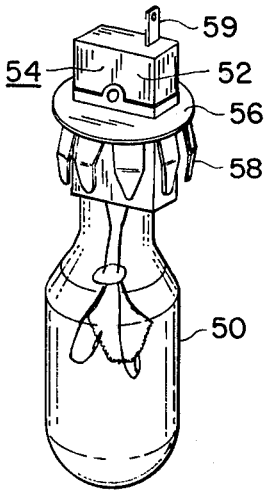

FIGS. 3*a* and 3*b* illustrate the details of the sockets 52 and the means for mounting them to the sheet metal of reflector 30. Insulated portion 54 is held in circular base portion 56 which is made of metal. Base portion 56 has a series of fingers 58 which bear outwardly against the edge of the circular hole which was punched in the sheet metal for the purpose of accepting the socket. This provides electrical contact between base 56 and reflector 30 as well as holding those two members in rigid mechanical contact.

As can be seen from FIGS. 3*a* and 3*b*, each socket has only one terminal 59. The electrical connection that would ordinarily lead to a second terminal leads instead to base 56.

At this point the wiring and electrical operation of the invention are readily understood. Output lead 72 from the step-down transformer is connected directly to the sheet metal of reflector 30. This puts lead 72 in electrical contact with one side of each bulb filament by virtue of the internal connection within each socket.

Output lead 74 is connected to the terminal of each and every socket. One way of doing this is shown in FIG. 2. A single wire is strung perpendicular to the direction in which the concavities run, and a separate wire is taken off for each linear array of bulbs. An alternate scheme would use one long wire which would run back and forth in a serpentine fashion. The important feature to note is that the wire does not interfere with the reflective function of reflector 30 since it is located on the side of segments 32 or 34 that do not serve the reflective function.

I claim:

1. An illuminated sign comprising: first and second translucent faces;

an opaque edge circumscribing the translucent faces and defining therewith a sign interior;

means defining a reflective conductive surface mounted within the sign interior, supported from the opaque edge, and extending generally parallel to the first translucent face;

the reflective conductive surface having a corrugated configuration, thereby defining first and second alternating sets of channels, the first set of channels concave towards the first translucent face and having bottoms generally parallel to the first translucent face, and the second set of channels concave towards the second translucent face and having bottoms generally parallel to the second translucent face;

first and second pluralities of light bulbs, each light bulb having a first and a second terminal for electrical connection, the first plurality of light bulbs mounted to the reflective conductive surface between the reflective conductive surface and the first translucent face and within the first set of channels proximate the bottoms thereof, the second plurality of light bulbs mounted to the reflective conductive surface between the reflective conductive surface and the second translucent face and within the second set of channels and proximate the bottoms thereof; and electrical connection means for connecting the light bulbs to an electrical power source producing a voltage of at most 24 volts;

such that connection of the electrical power source to the first plurality of light bulbs causes illumination of the first translucent face, and connection of the electrical power source to the second plurality of light bulbs causes illumination of the second translucent face.

2. The sign of claim 1 wherein the electrical connection means comprises:

means electrically connecting the first terminal of each light bulb to the reflective conductive surface;

means for electrically connecting the reflective conductive surface to a first terminal of the power source; and means for electrically connecting the second terminal of each light bulb to a second terminal of the power source.

3. The sign of claim 2 wherein the means for connecting the second terminal of each light bulb to the power source includes a wire on the side of the reflective conductive surface opposite the bulb.

4. The sign of claim 2 wherein the means electrically connecting the first terminal of each light bulb to the reflective conductive surface comprises:

a plurality of bayonet sockets corresponding to the aggregate of the first and second pluralities of light bulbs, each light bulb being mounted in a bayonet socket, each bayonet socket having a portion electrically connected to the first terminal of a light bulb mounted therein, and wherein the channel bottoms define a plurality of holes corresponding to the plurality of bayonet sockets, each hole adapted to mount one of the bayonet sockets such that mounting of one of the bayonet sockets in a hole provides electrical connection between the reflective conductive surface and the portion of the bayonet socket that is electrically connected to the first terminal of the light bulb mounted therein.

5. The sign of claim 1 wherein the bulbs are rated for operation at 14 volts, and also including voltage means for generating a voltage less than 10.5 volts, operatively connected to the light bulbs.

6. The invention of claim 1 wherein the light bulbs are spaced from the translucent face at a distance of at most twice the distance between immediately adjacent light bulbs on the reflective conductive surface.

7. The sign of claim 1 wherein the reflective conductive surface has a profile in the form of a doubly truncated sawtooth.

8. The sign of claim 1 wherein the second translucent face is parallel to the first translucent face.

9. A dual faced illuminated sign comprising:

first and second parallel translucent faces for the display of advertising messages;

an opaque edge circumscribing the translucent faces and defining therewith a sign interior;

a sheet metal reflector mounted within the sign interior, supported from the opaque edge, and extending generally parallel to the translucent faces;

the reflector having a truncated sawtooth configuration, thereby defining first and second alternating sets of channels having flat bottoms parallel to the translucent faces, the first set of channels concave towards the first translucent face, and the second set of channels concave towards the second translucent face;

first and second pluralities of bayonet bases mounted in the first and second sets of channels respectively in a generally uniformally spaced configuration;

first and second pluralities of light bulbs corresponding to the first and second pluralities of bases, mounted in the first and second pluralities of bayonet bases proximate the bottoms of the channels, each light bulb having a first and second terminal for electrical connection, the light bulbs being held in spaced relation from the translucent face at a distance no more than twice the distance between immediately adjacent light bulbs;

an electrical power source for generating a voltage of at most 24 volts;

electrical connection means for connecting the light bulbs to the electrical power source;

such that connection of the electrical power source to the first plurality of light bulbs causes illumination of the first translucent face, and connection of the electrical power source to the second plurality of light bulbs causes illumination of the second translucent face.

10. The invention of claim 8 wherein the electrical connection means comprises means electrically connecting the first terminal of each light bulb to a portion of each corresponding bayonet base;

means for electrically connecting the portions of the bayonet bases to the reflector;

means for electrically connecting the reflector to the first output terminal of the power source;

means for electrically connecting the second terminal of each light bulb to the second output terminal of the power source.

* * * * *